US010382851B1

(12) United States Patent
Smith

(10) Patent No.: US 10,382,851 B1
(45) Date of Patent: Aug. 13, 2019

(54) EAR-WEARABLE WIRELESS COMMUNICATION FLASHLIGHT COMBINATION DEVICE

(71) Applicant: Antoine Smith, Bellwood, IL (US)

(72) Inventor: Antoine Smith, Bellwood, IL (US)

( * ) Notice: Subject to any disclaimer, the term of this patent is extended or adjusted under 35 U.S.C. 154(b) by 0 days.

(21) Appl. No.: 16/103,637

(22) Filed: Aug. 14, 2018

(51) Int. Cl.
*H04R 1/02* (2006.01)
*H04R 1/10* (2006.01)

(52) U.S. Cl.
CPC ..... *H04R 1/028* (2013.01); *H04R 1/1016* (2013.01); *H04R 1/1025* (2013.01); *H04R 2420/07* (2013.01)

(58) Field of Classification Search
CPC .... H04R 1/028; H04R 1/1016; H04R 1/1025; H04R 2420/07
See application file for complete search history.

(56) References Cited

U.S. PATENT DOCUMENTS

| | | | | |
|---|---|---|---|---|
| 6,637,910 | B1 | 10/2003 | Mehler | |
| 7,114,823 | B2 | 10/2006 | McCullough | |
| 7,539,525 | B2 * | 5/2009 | Kim | H04M 1/05 379/433.13 |
| D717,280 | S | 11/2014 | He | |
| 9,699,281 | B2 * | 7/2017 | Fisher | H04M 1/6066 |
| 10,110,984 | B2 * | 10/2018 | Rich | H04R 1/1016 |
| 2002/0027777 | A1 | 3/2002 | Takasu | |
| 2003/0081766 | A1 | 5/2003 | Quarre | |
| 2004/0136178 | A1 * | 7/2004 | Yu | F21V 21/0885 362/103 |
| 2006/0291686 | A1 * | 12/2006 | Hlas | H04R 1/086 381/381 |
| 2007/0223215 | A1 * | 9/2007 | Chou | F21L 4/04 362/157 |
| 2008/0152183 | A1 * | 6/2008 | Janik | H04M 1/05 381/375 |
| 2011/0286615 | A1 * | 11/2011 | Olodort | H04R 1/1025 381/311 |

FOREIGN PATENT DOCUMENTS

| | | |
|---|---|---|
| WO | WO2014043179 | 3/2014 |

* cited by examiner

*Primary Examiner* — Mary Ellen Bowman

(57) ABSTRACT

An ear-wearable wireless communications flashlight combination device for illuminating a space in front of a user includes an earpiece that is configured to position around a top and a rear of an ear of a user. The earpiece comprises a battery, a transceiver and a boom. The transceiver is operationally coupled to the battery so that the earpiece is configured for wireless communication. A light switch is coupled to the earpiece and is operationally coupled to a battery. A bulb is coupled to a terminus of the boom and is operationally coupled to the light switch. The light switch is configured to selectively couple the bulb to the battery to illuminate a space in front of the user.

16 Claims, 6 Drawing Sheets

EAR-WEARABLE WIRELESS COMMUNICATION FLASHLIGHT COMBINATION DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to flashlight combination devices and more particularly pertains to a new flashlight combination device for illuminating a space in front of a user.

BRIEF SUMMARY OF THE INVENTION

An embodiment of the disclosure meets the needs presented above by generally comprising an earpiece that is configured to position around a top and a rear of an ear of a user. The earpiece comprises a battery, a transceiver and a boom. The transceiver is operationally coupled to the battery so that the earpiece is configured for wireless communication. A light switch is coupled to the earpiece and is operationally coupled to a battery. A bulb is coupled to a terminus of the boom and is operationally coupled to the light switch. The light switch is configured to selectively couple the bulb to the battery to illuminate a space in front of the user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
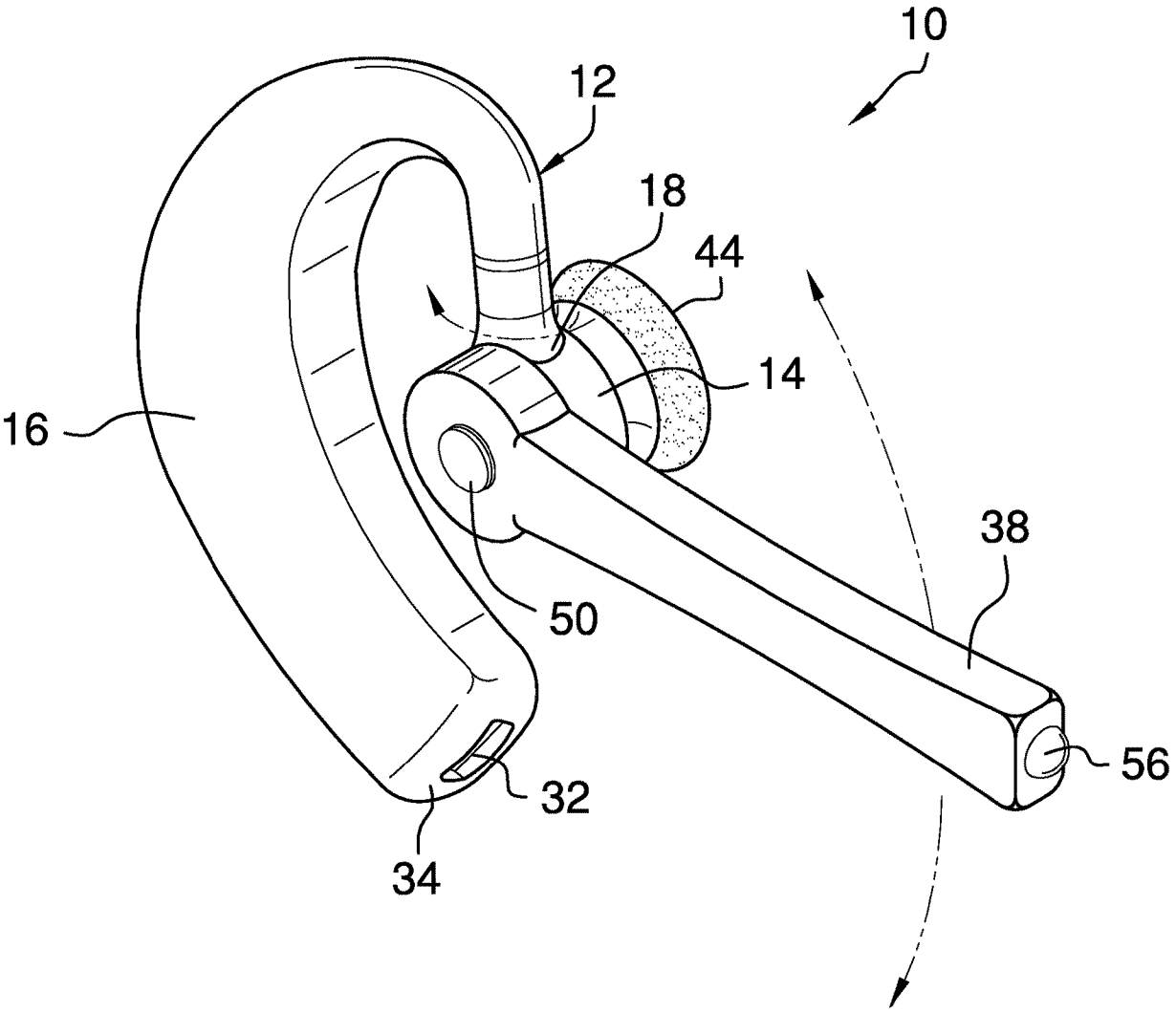
FIG. 1 is an isometric perspective view of an ear-wearable wireless communications flashlight combination device according to an embodiment of the disclosure.

With reference now to the drawings, and in particular to FIGS. 1 through 7 thereof, a new flashlight combination device embodying the principles and concepts of an embodiment of the disclosure and generally designated by the reference numeral 10 will be described.

As best illustrated in FIGS. 1 through 7, the ear-wearable wireless communications flashlight combination device 10 generally comprises an earpiece 12 that is configured to position around a top and a rear of an ear of a user.

Figure 6:
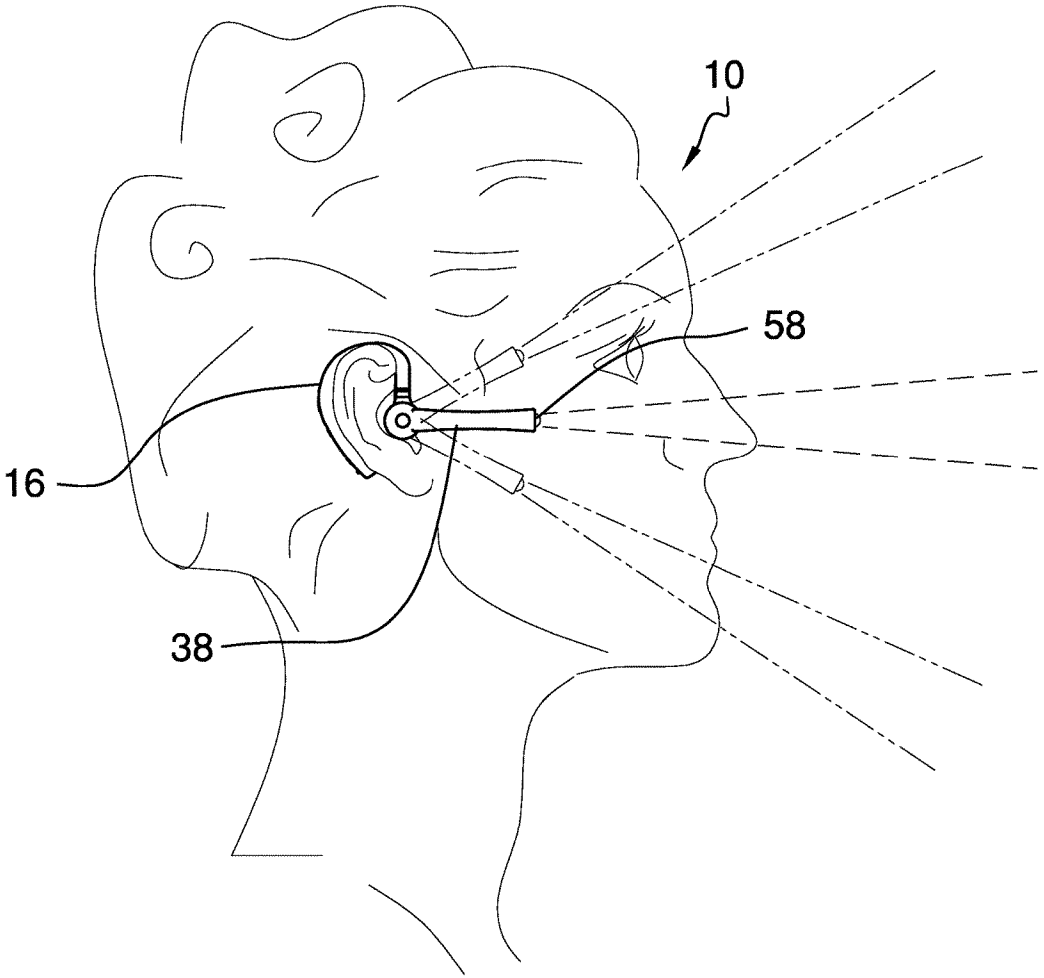
FIG. 6 is an in-use view of an embodiment of the disclosure.
Figure 7:
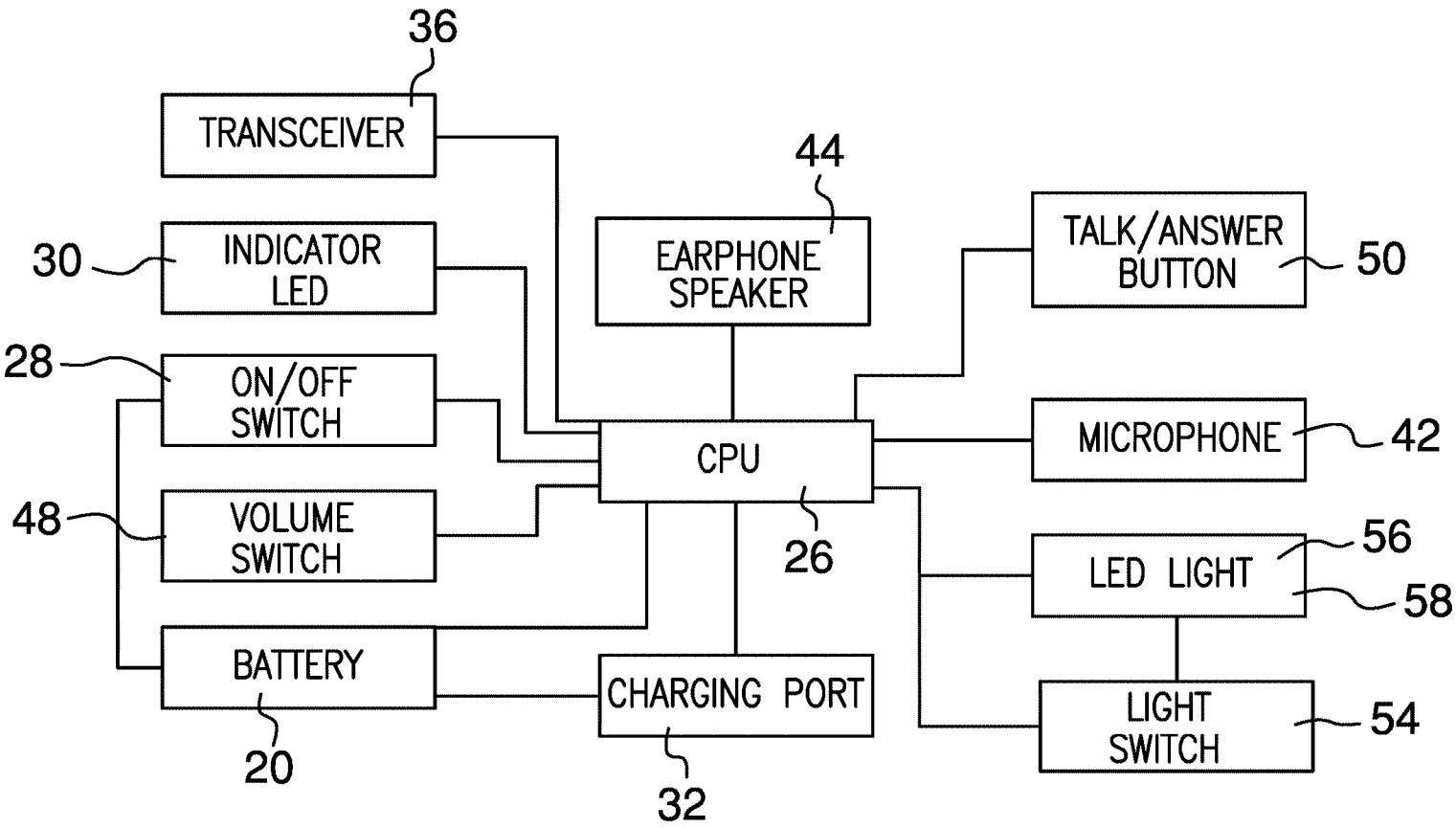
FIG. 7 is a block diagram of an embodiment of the disclosure.

The earpiece 12 comprises a cylinder 14 and an ear hook 16 that is coupled by a first end 18 to the cylinder 14. The ear hook 16 is arcuate and is configured to position around the top and the rear of the ear of the user to couple the earpiece 12 to the ear of the user, as shown in FIG. 6. The ear hook 16 is rotationally coupled to the cylinder 14 so that the ear hook 16 is positioned to be swiveled relative to the cylinder 14, which facilitates positioning of the earpiece 12 on the ear.

A battery 20 is positioned in the ear hook 16. An opening 22 is positioned in the ear hook 16 proximate to the battery 20 and is configured to allow access to the battery 20. A panel 24 is selectively couplable to the ear hook 16 to close the opening 22.

Figure 4:
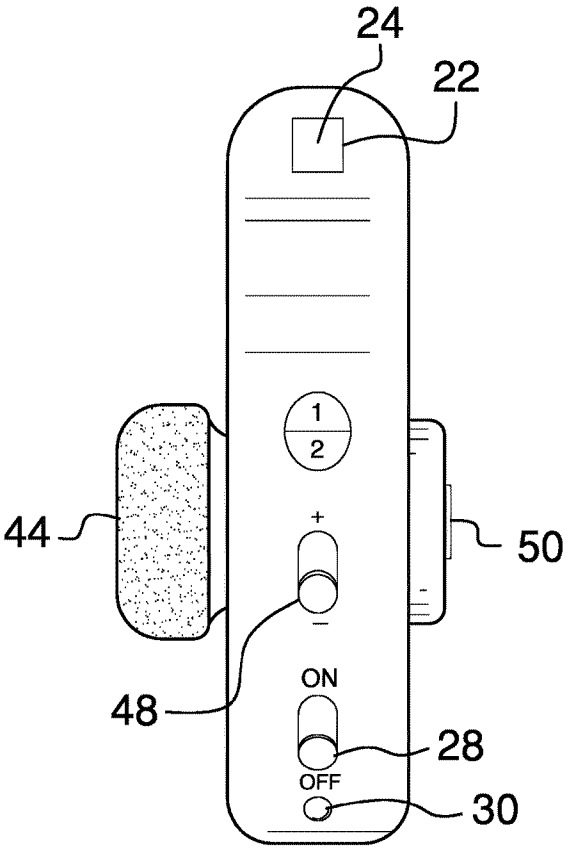
FIG. 4 is a back view of an embodiment of the disclosure.

A microprocessor 26 is positioned in the ear hook 16 and is operationally coupled to the battery 20. An ON/OFF switch 28, which is slide-switch type, is coupled to the ear hook 16, as shown in FIG. 4. The ON/OFF switch 28 is operationally coupled to the microprocessor 26 as well as the battery 20 and is configured to selectively couple the microprocessor 26 to the battery 20 to power the microprocessor 26.

An indicator light 30, which is light emitting diode type, is coupled to the ear hook 16 proximate to the ON/OFF switch 28, as shown in FIG. 4. The indicator light 30 is operationally coupled to the microprocessor 26. The microprocessor 26 is positioned to selectively couple the indicator light 30 to the battery 20 when the microprocessor 26 is coupled to the battery 20.

Figure 5:
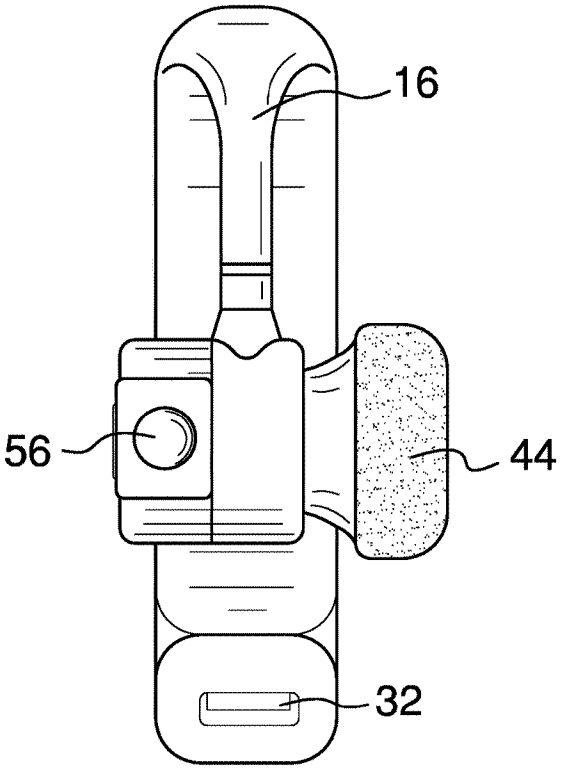
FIG. 5 is a front view of an embodiment of the disclosure.

A port 32 is positioned in a second end 34 of the ear hook 16, as shown in FIG. 5. The port 32 is operationally coupled to the battery 20 as well as the microprocessor 26 and is configured to couple the battery 20 to a source of direct current to charge the battery 20.

A transceiver 36 operationally coupled to the battery 20 so that the earpiece 12 is configured for wireless communication. The transceiver 36 is operationally coupled to the microprocessor 26 so that the transceiver 36 is configured to transmit and to receive audio signals.

Figure 2:
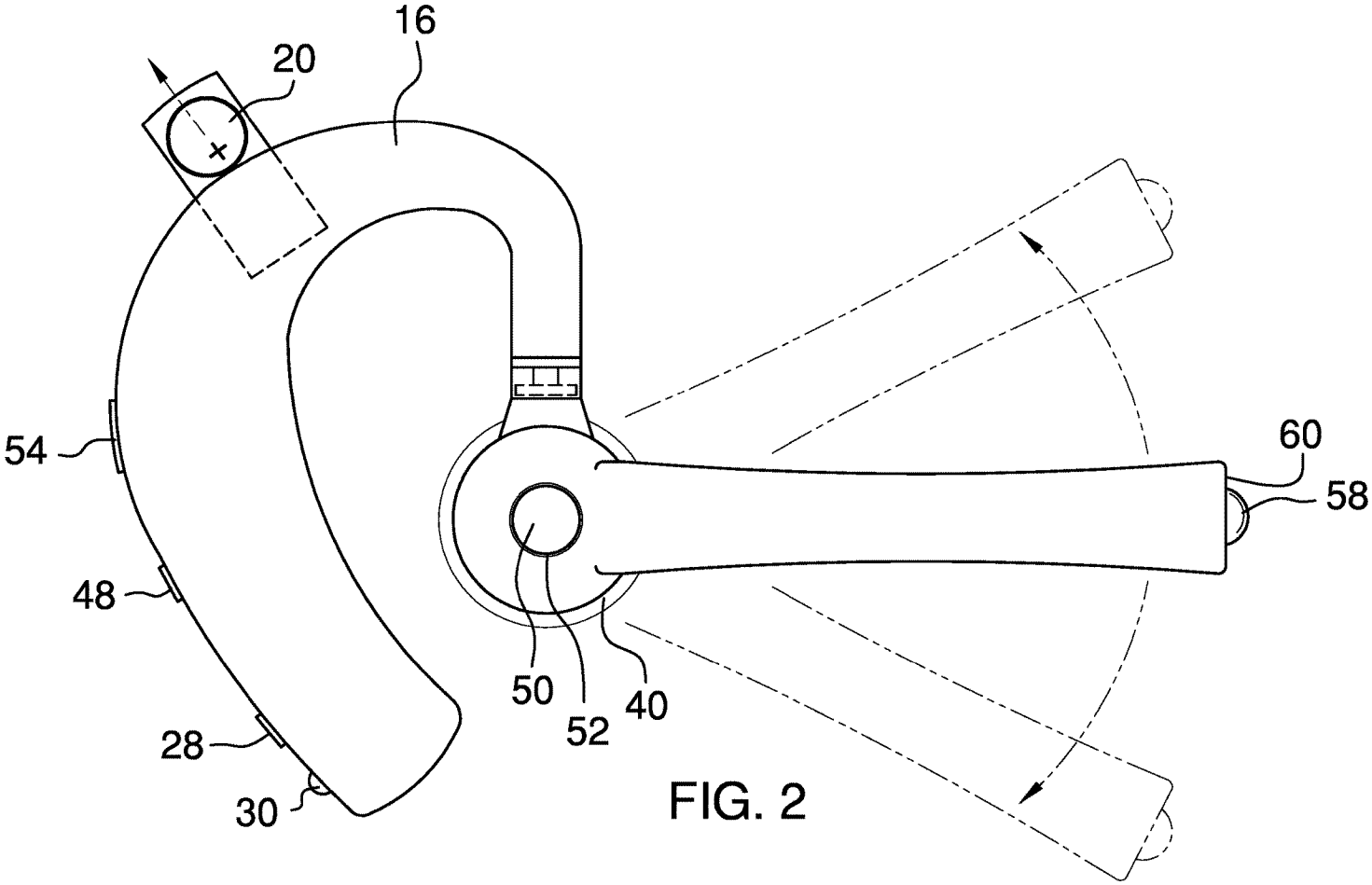
FIG. 2 is a side view of an embodiment of the disclosure.

A boom 38 is coupled to a first face 40 of the cylinder 14 and extends radially from the cylinder 14. The boom 38 is pivotally coupled to the cylinder 14. The boom 38 configured to be grasped in digits of a hand of the user, positioning the user to pivot the boom 38 relative to the cylinder 14, as shown in FIG. 2.

Figure 3:
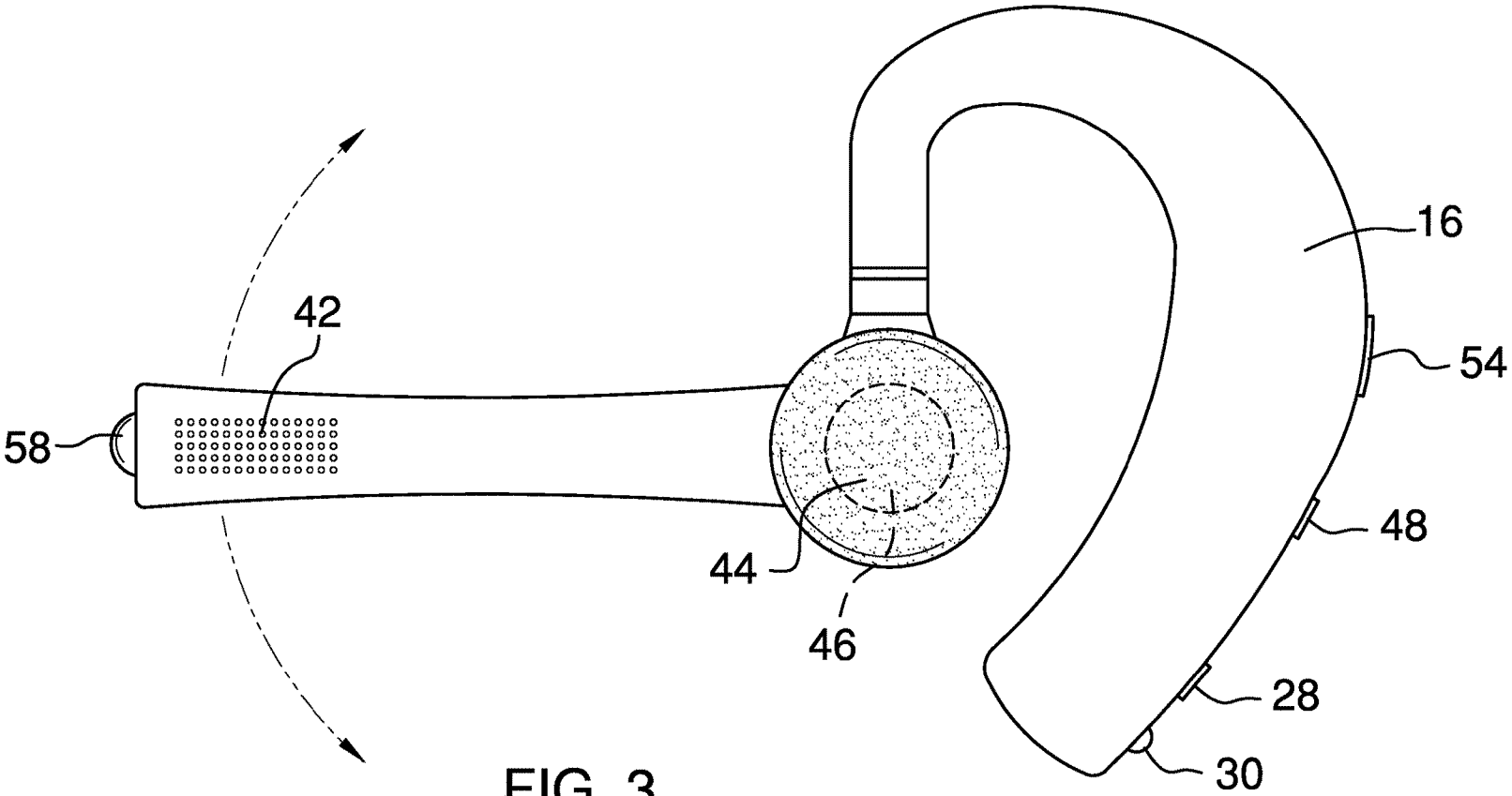
FIG. 3 is a side view of an embodiment of the disclosure.

A transducer 42 is coupled to the boom 38 distal from the cylinder 14, as shown in FIG. 3. The transducer 42 is operationally coupled to the microprocessor 26 and is configured to convert speech of the user to an electrical signal and to transmit the electrical signal to the microprocessor 26.

A speaker 44 is coupled to a second face 46 of the cylinder 14, as shown in FIG. 3, so that the speaker 44 is positioned proximate to an ear canal of the user when the ear hook 16 is positioned around the top and the rear of the ear of the user. The speaker 44 is configured to broadcast audio to the user.

A controller 48, which is slide switch type as shown in FIG. 4, is coupled to the ear hook 16 and is operationally coupled to the microprocessor 26. The controller 48 is configured to selectively signal the microprocessor 26 to adjust a volume of the speaker 44. The controller 48 is configured to selectively signal the microprocessor 26 to set a high volume and a low volume of the speaker 44.

A button 50, which is depressible, is coupled to the first face 40 of the cylinder 14 and extends through a hole 52 positioned in the boom 38, as shown in FIG. 2. The button 50 is operationally coupled to the microprocessor 26 and is configured to be selectively depressed to signal the microprocessor 26 to actuate the transducer 42, the speaker 44, and the transceiver 36.

A light switch 54, which is toggle type as shown in FIG. 4, is coupled to the ear hook 16 of the earpiece 12 and is operationally coupled to the battery 20. A bulb 56, which comprises a white light emitting diode 58, is coupled to a terminus 60 of the boom 38, as shown in FIG. 5. The bulb 56 is operationally coupled to the light switch 54 so that the light switch 54 is positioned to selectively couple the bulb 56 to the battery 20 to illuminate a space in front of the user.

In use, the earpiece 12 is positioned on the ear of the user and is used for communicating as with prior art earpieces. When the user requires illumination of the space in front of the user, the light switch 54 is used to couple the bulb 56 to the battery 20 to illuminate the space.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An ear-wearable wireless communications flashlight combination device comprising:

an earpiece configured for positioning around a top and a rear of an ear of a user, the earpiece comprising:

a battery, a transceiver operationally coupled to the battery wherein the earpiece is configured for wireless communication, a boom, a cylinder, the boom being coupled to a first face of the cylinder and extending radially from the cylinder;

an ear hook coupled by a first end to the cylinder, the ear hook being arcuate wherein the ear hook is configured for positioning around the top and the rear of the ear of the user for coupling the earpiece to the ear of the user, the battery being positioned in the ear hook;

a microprocessor positioned in the ear hook, the microprocessor being operationally coupled to the battery;

the transceiver being operationally coupled to the microprocessor wherein the transceiver is configured for transmitting and receiving audio signals;

a transducer coupled to the boom distal from the cylinder, the transducer being operationally coupled to the microprocessor wherein the transducer is configured for converting speech of the user to an electrical signal and for transmitting the electrical signal to the microprocessor; and a speaker coupled to a second face of the cylinder such that the speaker is positioned proximate to an ear canal of the user when the ear hook is positioned around the top and the rear of the ear of the user wherein the speaker is configured for broadcasting audio to the user;

a light switch coupled to the earpiece, the light switch being operationally coupled to the battery; and a bulb coupled to a terminus of the boom, the bulb being operationally coupled to the light switch wherein the light switch is positioned for selectively coupling the bulb to the battery for illuminating a space in front of the user.

2. The device of claim 1, further including the boom being pivotally coupled to the cylinder wherein the boom configured for grasping in digits of a hand of the user positioning the user for pivoting the boom relative to the cylinder.

3. The device of claim 1, further including an ON/OFF switch coupled to the ear hook, the ON/OFF switch being operationally coupled to the microprocessor and the battery wherein the ON/OFF switch is configured for selectively coupling the microprocessor to the battery for powering the microprocessor.

4. The device of claim 3, further including the ON/OFF switch being slide-switch type.

5. The device of claim 3, further including an indicator light coupled to the ear hook proximate to the ON/OFF switch, the indicator light being operationally coupled to the microprocessor wherein the microprocessor is positioned for selectively coupling the indicator light to the battery when the microprocessor is coupled to the battery.

6. The device of claim 5, further including the indicator light being light emitting diode type.

7. The device of claim 1, further including a port positioned in a second end of the ear hook, the port being operationally coupled to the battery and the microprocessor wherein the port is configured for coupling the battery to a source of direct current for charging the battery.

8. The device of claim 1, further including the ear hook being rotationally coupled to the cylinder wherein the ear hook is positioned for swiveling relative to the cylinder.

9. The device of claim 1, further comprising:

an opening positioned is the ear hook proximate to the battery wherein the opening is configured for allowing access to the battery; and a panel selectively couplable to the ear hook for closing the opening.

10. The device of claim 1, further including a controller coupled to the ear hook, the controller being operationally coupled to the microprocessor wherein the controller is configured for selectively signaling the microprocessor for adjusting a volume of the speaker.

11. The device of claim 10, further including the controller being slide switch type wherein the controller is configured for selectively signaling the microprocessor for setting a high volume and a low volume of the speaker.

12. The device of claim 1, further including a button coupled to the first face of the cylinder and extending through a hole positioned in the boom, the button being operationally coupled to the microprocessor, the button being depressible wherein the button is configured for selectively depressing for signaling the microprocessor for actuating the transducer, the speaker, and the transceiver.

13. The device of claim 1, further including the light switch being positioned on the ear hook.

14. The device of claim 1, further including the light switch being toggle type.

15. The device of claim 1, further including the bulb comprising a white light emitting diode.

16. An ear-wearable wireless communications flashlight combination device comprising:

an earpiece configured for positioning around a top and a rear of an ear of a user, the earpiece comprising:

a cylinder, an ear hook coupled by a first end to the cylinder, the ear hook being arcuate wherein the ear hook is configured for positioning around the top and the rear of the ear of the user for coupling the earpiece to the ear of the user, the ear hook being rotationally coupled to the cylinder wherein the ear hook is positioned for swiveling relative to the cylinder, a battery positioned in the ear hook, an opening positioned is the ear hook proximate to the battery wherein the opening is configured for allowing access to the battery, a panel selectively couplable to the ear hook for closing the opening, a microprocessor positioned in the ear hook, the microprocessor being operationally coupled to the battery, an ON/OFF switch coupled to the ear hook, the ON/OFF switch being operationally coupled to the microprocessor and the battery wherein the ON/OFF switch is configured for selectively coupling the microprocessor to the battery for powering the microprocessor, the ON/OFF switch being slide-switch type, an indicator light coupled to the ear hook proximate to the ON/OFF switch, the indicator light being operationally coupled to the microprocessor wherein the microprocessor is positioned for selectively coupling the indicator light to the battery when the microprocessor is coupled to the battery, the indicator light being light emitting diode type, a port positioned in a second end of the ear hook, the port being operationally coupled to the battery and the microprocessor wherein the port is configured for coupling the battery to a source of direct current for charging the battery, a transceiver operationally coupled to the battery wherein the earpiece is configured for wireless communication, the transceiver being operationally coupled to the microprocessor wherein the transceiver is configured for transmitting and receiving audio signals, a boom coupled to a first face of the cylinder and extending radially from the cylinder, the boom being pivotally coupled to the cylinder wherein the boom configured for grasping in digits of a hand of the user positioning the user for pivoting the boom relative to the cylinder, a transducer coupled to the boom distal from the cylinder, the transducer being operationally coupled to the microprocessor wherein the transducer is configured for converting speech of the user to an electrical signal and for transmitting the electrical signal to the microprocessor, a speaker coupled to a second face of the cylinder such that the speaker is positioned proximate to an ear canal of the user when the ear hook is positioned around the top and the rear of the ear of the user wherein the speaker is configured for broadcasting audio to the user, a controller coupled to the ear hook, the controller being operationally coupled to the microprocessor wherein the controller is configured for selectively signaling the microprocessor for adjusting a volume of the speaker, the controller being slide switch type wherein the controller is configured for selectively signaling the microprocessor for setting a high volume and a low volume of the speaker, and a button coupled to the first face of the cylinder and extending through a hole positioned in the boom, the button being operationally coupled to the microprocessor, the button being depressible wherein the button is configured for selectively depressing for signaling the microprocessor for actuating the transducer, the speaker, and the transceiver, a light switch coupled to the earpiece, the light switch being operationally coupled to the battery, the light switch being positioned on the ear hook, the light switch being toggle type; and a bulb coupled to a terminus of the boom, the bulb being operationally coupled to the light switch wherein the light switch is positioned for selectively coupling the bulb to the battery for illuminating a space in front of the user, the bulb comprising a white light emitting diode.

* * * * *